US009403209B2

(12) United States Patent
Cogan et al.

(10) Patent No.: US 9,403,209 B2
(45) Date of Patent: Aug. 2, 2016

(54) METHODS FOR SAND CORE GAS EVACUATION AND RELATED SYSTEMS AND APPARATUS

(71) Applicant: GM GLOBAL TECHNOLOGY OPERATIONS LLC, Detroit, MI (US)

(72) Inventors: Christopher D. Cogan, Defiance, OH (US); James T. Singer, Ney, OH (US); Stephen M. Fitch, Oakwood, OH (US); Maurice G. Meyer, Defiance, OH (US); David D. Goettsch, Shelby Township, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 13/746,558

(22) Filed: Jan. 22, 2013

(65) Prior Publication Data

US 2014/0202651 A1 Jul. 24, 2014

(51) Int. Cl.

| | |
|---|---|
| ***B22C 9/02*** | (2006.01) |
| ***B22C 9/10*** | (2006.01) |
| ***B22D 27/15*** | (2006.01) |
| ***B22D 18/06*** | (2006.01) |

(52) U.S. Cl.

CPC . *B22D 18/06* (2013.01); *B22C 9/02* (2013.01); *B22C 9/103* (2013.01); *B22C 9/106* (2013.01); *B22D 27/15* (2013.01)

(58) Field of Classification Search

None

See application file for complete search history.

(56) References Cited

U.S. PATENT DOCUMENTS

| | | | | |
|---|---|---|---|---|
| 3,435,886 | A * | 4/1969 | Walter | 164/410 |
| 5,348,073 | A * | 9/1994 | Kubo et al. | 164/457 |
| 6,666,254 | B2 * | 12/2003 | Voigt | B22C 9/103 164/119 |
| 2004/0149416 | A1 * | 8/2004 | Siak et al. | 164/12 |
| 2006/0048911 | A1 * | 3/2006 | Newcomb | 164/98 |
| 2010/0212854 | A1 * | 8/2010 | Walker et al. | 164/16 |

FOREIGN PATENT DOCUMENTS

| | | | |
|---|---|---|---|
| CA | 2404952 | | 10/2001 |
| CN | 102335723 | | 2/2012 |
| JP | 07164101 | A * | 6/1995 |

OTHER PUBLICATIONS

Concise Explanation of Relevance of CA2404952.
Concise Explanation of Relevance of CN102335723.

* cited by examiner

*Primary Examiner* — Kevin E Yoon
*Assistant Examiner* — Jacky Yuen
(74) *Attorney, Agent, or Firm* — Phillips Ryther & Winchester; Matthew D. Thayne

(57) ABSTRACT

Methods, systems, and apparatus for reduction of gas pressure within a core, such as a sand casting core package, during a casting process in order to reduce bubble defects. Some embodiments may comprise a mold configured to receive a molten metal to create a metal casting, such as an engine block casting. The mold may comprise a mold core configured to create a cavity within the metal casting. The system may further comprise a filling device configured for delivering a molten metal into the mold for creating the metal casting. The mold core may comprise a material that is permeable to certain gases known to often result in bubble defects. The system may further comprise a vacuum configured to be coupled with the mold to reduce gas pressure within a permeable portion of the mold in order to reduce the incidence of bubble defects within the casting.

12 Claims, 8 Drawing Sheets

METHODS FOR SAND CORE GAS EVACUATION AND RELATED SYSTEMS AND APPARATUS

TECHNICAL FIELD

This disclosure relates to methods, apparatus, and systems for reducing gas pressure within a core and for manufacturing engine blocks and other castings using processes that involve such gas pressure reduction. More specifically, but not exclusively, this disclosure relates to methods, apparatus, and systems for evacuating gas from a core package to reduce the core gas pressure and thereby reduce the entrance of gas into molten metal within a mold cavity.

BACKGROUND

Internal combustion engine blocks are often manufactured using a sand casting process. Such processes typically involve use of a mold package that is assembled from a plurality of sand cores or mold segments that define the surfaces of an engine block casting. A molten metal is then poured into an opening formed within the mold package that, once cooled, forms the engine block.

Unfortunately, defects in engine block castings formed by such sand casting processes are often introduced by the presence of gases within the mold and/or mold materials. Such gases can result in bubbles forming within the casting, which may lead to defects and, ultimately, scrapping of the casting. For example, when a water jacket core becomes submerged in molten metal, the pressure of certain gases in the core may rise at a faster rate than the head pressure of the metal. Thus, gases may form and be introduced into the metal from within the water jacket core and/or other portions of the mold.

The present inventors have therefore determined that it would be desirable to provide methods, systems, and apparatus for manufacturing engine blocks and other castings that overcome one or more of the foregoing limitations and/or other limitations of the prior art by, for example, preventing or at least reducing gas pressure within a mold to prevent or at least reduce scrap and/or other problems caused by bubble defects.

SUMMARY

Methods, systems, and apparatus are disclosed herein for manufacturing engine blocks and other castings that involve reduction of gas pressure within a mold, such as a sand casting mold, in order to reduce bubble defects.

In some implementations of methods for reducing gas pressure within an at least partially permeable mold for manufacturing a metal casting, a mold may be provided that comprises a mold core configured to create a cavity within a metal casting, such as a water jacket core. The mold core may comprise a material that is permeable to gases introduced into the mold during a casting process. A molten metal may be introduced into the mold to create a metal casting, such as an engine block casting. A vacuum may be applied to a permeable portion of the mold during the step of introducing the molten metal into the mold to reduce gas pressure within the permeable portion of the mold.

In some implementations, the step of applying a vacuum may comprise applying a vacuum to a conduit formed within the mold. In some implementations, multiple such conduits may be used. One or more of the conduits may extend into the mold and may terminate adjacent to, or into, a portion of the mold that has been known to be particularly vulnerable to pressure build up, such as cores having marginal core print areas including, for example, the water jacket core of an engine block mold. In some implementations, the conduit(s) may extend into the mold and terminate very close to a peripheral edge of such a desired location, such as within about 10 mm of the water jacket core, for example. In other embodiments, one or more conduits may extend all of the way into the portion of the mold for which a reduction in pressure is desired.

The applied vacuum may, in some embodiments and implementations, be between about −0.2 psi and about −1.0 psi. In some such embodiments and implementations, the vacuum may be between about −0.4 psi and about −0.6 psi.

The mold may further comprise a vacuum plate configured to be positioned adjacent to the mold to apply the vacuum to one or more selected locations within the mold. The vacuum plate may comprise one or more vacuum ports. The vacuum port(s) may be fluidly connected with one or more conduits. The conduit(s) may extend into the mold and may be fluidly connected with one or more desired locations within the mold that comprise a permeable material, such as a sand material. In some embodiments and implementations, the conduit(s) may extend into the mold and terminate adjacent to a desired permeable location within the mold. In some embodiments and implementations, the conduit(s) may terminate within such a desired location within the mold. In other embodiments and implementations, the vacuum may instead be applied directly to a desired permeable location in the mold within an intervening conduit. One or more vacuum manifolds may also be provided to facilitate coupling of the vacuum to one or more of the vacuum ports.

In another implementation of a method according to the present disclosure, namely, a method for manufacturing an engine block, a mold comprising a water jacket core configured to create a water jacket cavity within an engine block casting may be provided. The water jacket core may comprise a sand material that is permeable to gases introduced into the water jacket core during a casting process. A vacuum manifold may be coupled to a plurality of vacuum ports. At least one of the vacuum ports may be fluidly connected with a conduit extending into the mold. One or more of the conduits may terminate adjacent to the water jacket core.

A molten metal may be delivered into the mold, such as by pouring or pumping the molten metal into the mold, for example, to create an engine block casting. During the step of delivering the molten metal into the mold, a vacuum may be applied to the vacuum manifold in order to reduce gas pressure within the water jacket core. The plurality of vacuum ports may be positioned within a vacuum plate positioned adjacent to the mold during the step of applying a vacuum to the vacuum manifold. The vacuum plate may further comprise a plurality of mold ports that are fluidly connected with the vacuum ports and positioned adjacent to the mold such that a vacuum applied to the vacuum ports will be applied to one or more locations within the mold.

An embodiment of a system for manufacturing a metal casting may comprise a mold configured to receive a molten metal to create a metal casting. The mold may comprise a mold core configured to create a cavity within the metal casting, such as an engine block casting. The mold core may comprise, for example, a water jacket core configured to create a water jacket cavity within an engine block casting.

The system may further comprise a filling device configured for delivering, such as pouring or pumping, a molten metal into the mold for creating the metal casting. In such embodiments, the mold core may comprise a material that is permeable to gases introduced into the mold during a process of delivering the molten metal into the mold using the filling device. In some embodiments, the filling device may comprise a robot, such as a robotic pouring system.

The system may further comprise a vacuum configured to be coupled with the mold to reduce gas pressure within a permeable portion of the mold. A vacuum plate configured to be coupled with the vacuum may also be provided. The vacuum plate may comprise one or more vacuum ports configured to facilitate coupling of the vacuum with the mold. One or more of the vacuum ports may be fluidly connected with one or more conduits. The conduit(s) may extend into the mold and may, in some embodiments, terminate within the mold adjacent to a desired permeable portion of the mold. For example, in embodiments in which the mold core comprises a water jacket core configured to create a water jacket cavity within an engine block casting, one or more of the conduits may extend into the mold and may terminate adjacent to the water jacket core. In some embodiments, the conduit may terminate in the mold within about 10 mm of the water jacket core but without extending into the water jacket core. Other embodiments and implementations, however, are contemplated in which one or more conduits enter into and terminate within the water jacket core and/or one or more other desired locations within the mold.

In some embodiments, the system may further comprise a cover core and/or a slab core. The slab core may be positioned adjacent to the cover core, and the mold core may be positioned adjacent to the slab core. In embodiments comprising a vacuum plate, the vacuum plate may also be positioned adjacent to the slab core such that the slab core is positioned in between the mold core and the vacuum plate.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

A detailed description of apparatus, systems, and methods consistent with various embodiments and implementations of the present disclosure is provided below. While several embodiments and implementations are described, it should be understood that disclosure is not limited to any of the specific embodiments and/or implementations disclosed, but instead encompasses numerous alternatives, modifications, and equivalents. In addition, while numerous specific details are set forth in the following description in order to provide a thorough understanding of the embodiments disclosed herein, some embodiments can be practiced without some or all of these details. Similarly, some implementations can be practiced without some or all of the steps disclosed below. Moreover, for the purpose of clarity, certain technical material that is known in the related art has not been described in detail in order to avoid unnecessarily obscuring the disclosure.

The embodiments of the disclosure will be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the systems and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified.

Embodiments of the methods, systems, and apparatus disclosed herein may be used to reduce or eliminate gas pressure within an at least partially permeable mold, or an at least partially permeable portion of a mold, for manufacturing a metal casting, such as a casting mold for an engine block. Such methods, systems, and apparatus may thereby reduce or eliminate bubble defects to reduce or eliminate bubble scrap in precision sand castings, such as water jacket core bubble scrap. By providing for such improvements, some embodiments may also allow for elimination of certain inspection steps during manufacturing, such as X-ray inspection of engine blocks for quality control. In fact, it is contemplated that some systems configured in accordance with the teachings provided herein may be used to wholly eliminate X-ray inspection.

Figure 1:
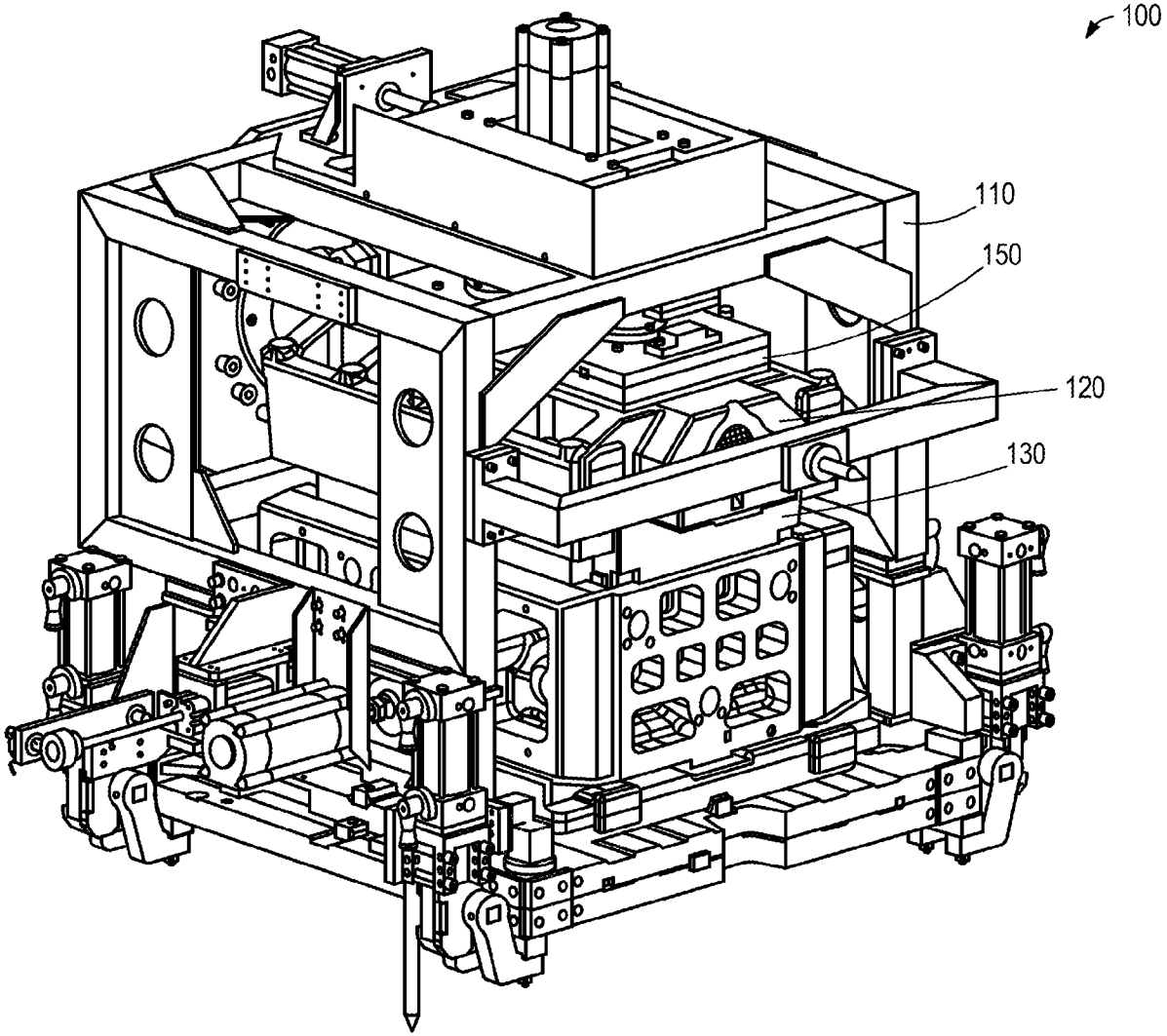
FIG. 1 illustrates a perspective view of one embodiment of a system for manufacturing a metal casting including a vacuum for reducing gas pressure within one or more portions of the casting mold.

With reference now to the accompanying drawings, one embodiment of a system for manufacturing a metal casting is shown in FIG. 1 at 100. System 100 comprises frame 110, cover core 120, head deck slab core 130, water jacket core 140 (not visible in FIG. 1), and vacuum plate 150. As those of ordinary skill in the art will appreciate, various other components of system 100 that are well-known in the art have not been described in detail in order to avoid unnecessarily obscuring the disclosure.

Frame 110 may, in some embodiments, be part of a robotic system, such as a robotic pouring system. In other embodiments, system 100 may comprise one or more such robotic systems that may, in some embodiments, operate in conjunction with, rather than be part of, frame 110. Some embodiments may be part of another device or system, such as a fixed automation system, rollover device, etc.

Cover core 120, slab core 130, and one or more other cores, such as water jacket core 140 (shown in FIG. 4 and described below in conjunction therewith), may together make up a mold. In other words, in some embodiments, a mold of a system for manufacturing a metal casting may comprise a cover core, a slab core, a water jacket core, and one or more other cores as desired. In some embodiments, the term "mold core" may refer to one of the various individual cores that may make up a mold.

Figure 4:
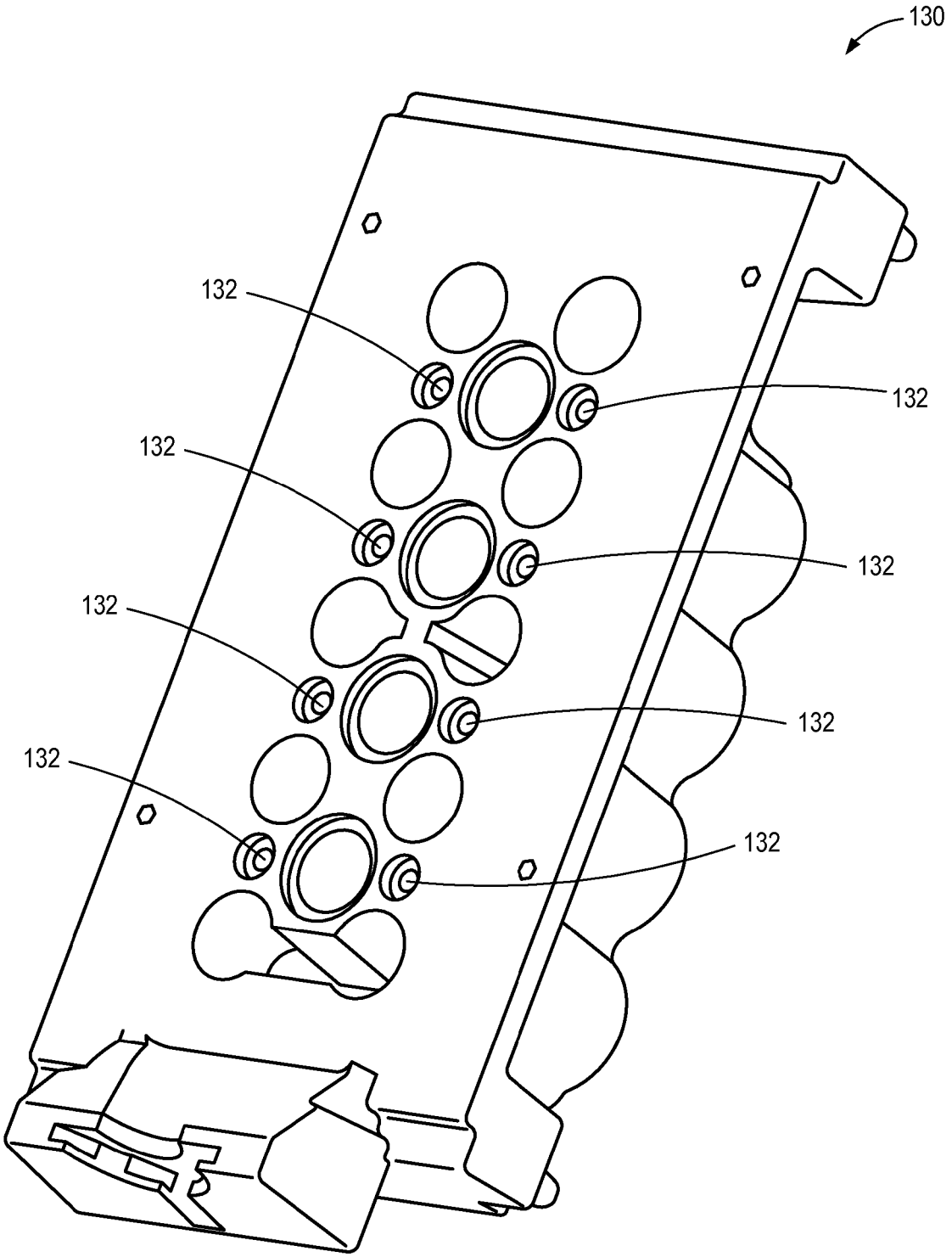
FIG. 4 illustrates an upper perspective view of an embodiment of a slab core of the system depicted in FIG. 1.

As shown in FIG. 1, slab core 130 may be positioned adjacent to cover core 120. And, as shown in FIG. 4, water jacket core 140 may be positioned adjacent to slab core 130. As described in greater detail below, in some embodiments, one or more conduits may be formed within one or more portions of the mold that are configured for applying a vacuum to one or more desired locations within, or on, the mold.

For example, one or more conduits may be formed within slab core 130 and/or cover core 120, as described in greater detail below. In some embodiments, such conduit(s) may terminate adjacent to another piece or portion of the mold, such as adjacent to water jacket core 140. In embodiments comprising an at least partially permeable mold for manufacturing a metal casting, placement of one or more conduits adjacent to, for example, one or more cores having marginal core print areas, such as the water jacket core of an engine block mold, may reduce gas pressure build up in the adjacent water jacket core following application of a vacuum to such conduit(s). In some embodiments, a vacuum may be applied in between the water jacket leg prints in the slab core.

In some embodiments, the system may further comprise a filling device configured for delivering, such as pouring or pumping, a molten metal into the mold for creating the metal casting. In such embodiments, the mold may comprise a material that is permeable to gases introduced into the mold during a process of delivering the molten metal into the mold using the filling device. In some embodiments, the filling device may comprise a robot, such as a robotic pouring system.

Figure 2:
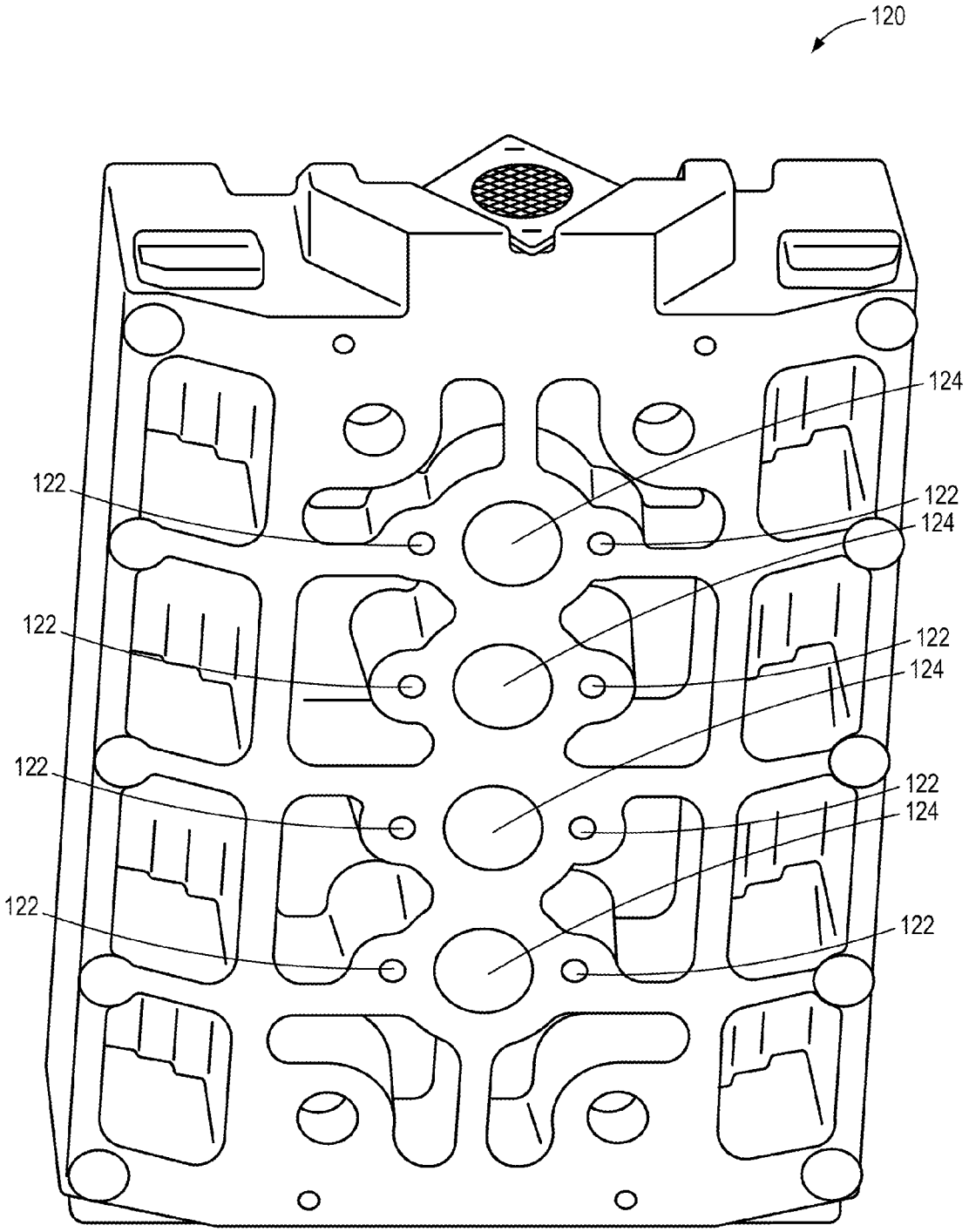
FIG. 2 illustrates an upper perspective view of an embodiment of a cover core of the system depicted in FIG. 1.
Figure 3:
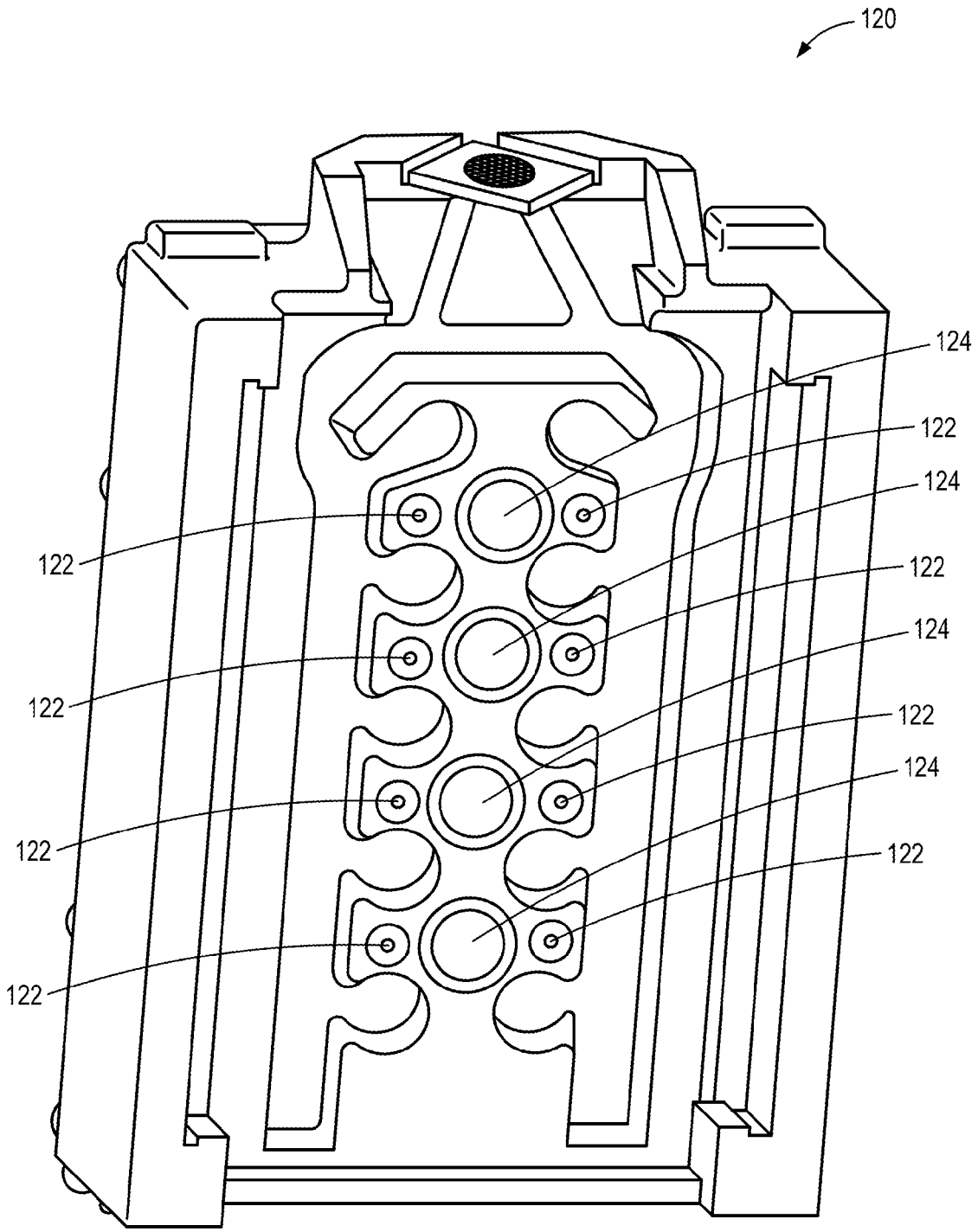
FIG. 3 illustrates a lower perspective view of the cover core of FIG. 2.

FIG. 2 illustrates an upper perspective view of an embodiment of a cover core 120 of the system 100 depicted in FIG. 1. FIG. 3 illustrates a lower perspective view of cover core 120. As shown in these figures, cover core 120 comprises eight conduits 122. As can be seen by reviewing and comparing FIGS. 2 and 3, each of the conduits 122 extends all of the way through cover core 120. Conduits 122 are also positioned on opposite sides of induction tunnels 124. More particularly, two conduits 122 are positioned adjacent opposite ends of each of the four induction tunnels 124. By forming conduits 122 such that they extend all of the way through cover core 120, a vacuum may be applied to one or more locations within the mold below cover core 120, as described below.

Figure 5:
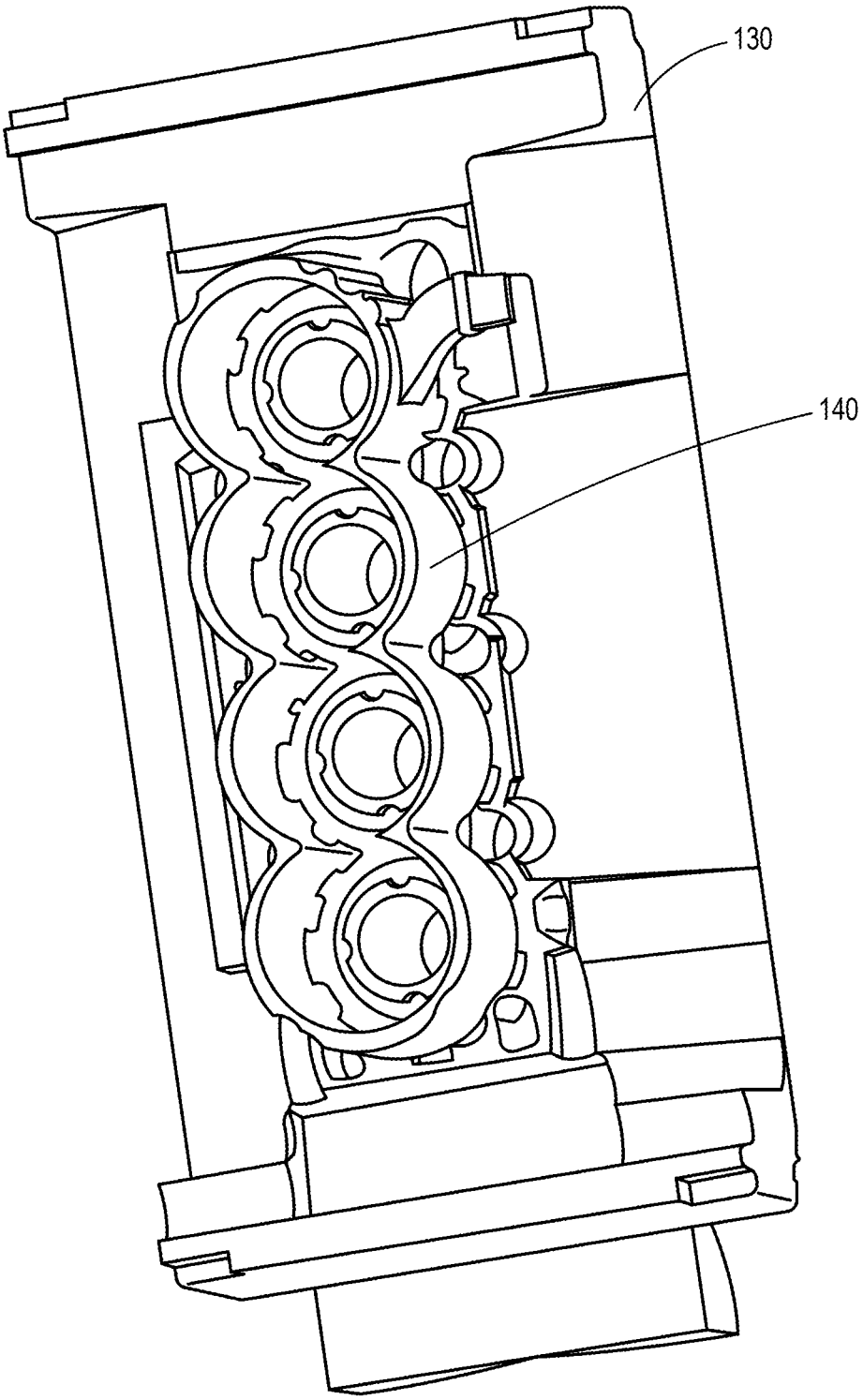
FIG. 5 illustrates a lower perspective view of the slab core of FIG. 4, and further illustrates an embodiment of an adjacent water jacket core.

FIG. 4 illustrates an upper perspective view of an embodiment of head deck slab core 130 of system 100. FIG. 5 illustrates a lower perspective view of the head deck slab core 130 of system 100, and further illustrates an embodiment of an adjacent water jacket core 140. As shown in these figures, slab core 130 comprises a plurality of conduits 132. Conduits 132 are configured to be positioned adjacent to conduits 122 within cover core 120 when cover core 120 is positioned adjacent to slab core 130 within system 100. More particularly, conduits 132 are configured to be aligned with conduits 122 of cover core 120 so as to create extended conduits each made up of a conduit 122 extending through cover core and a conduit 132 formed within slab core 130.

In some embodiments, a plurality of fittings or couplings may be used to ensure that the vacuum applied to conduits 122 are effectively transferred to conduits 132. However, in other embodiments, conduits 122 and 132 may simply be positioned adjacent to one another without any such fittings or couplings.

Unlike conduits 122, conduits 132 do not extend all of the way through slab core 130. Instead, conduits 132 comprise blind holes that terminate adjacent to water jacket core 140. In some embodiments, one or more conduits 132 may terminate within slab core 130 at a distance of, for example, about 10 mm from water jacket core 140. In some embodiments, one or more conduits 132 may terminate between two water jacket leg prints in the slab core 130. However, other embodiments are contemplated in which the conduits 132, or other conduits, terminate within the water jacket core 140 and/or other desired locations within the mold.

Figure 6:
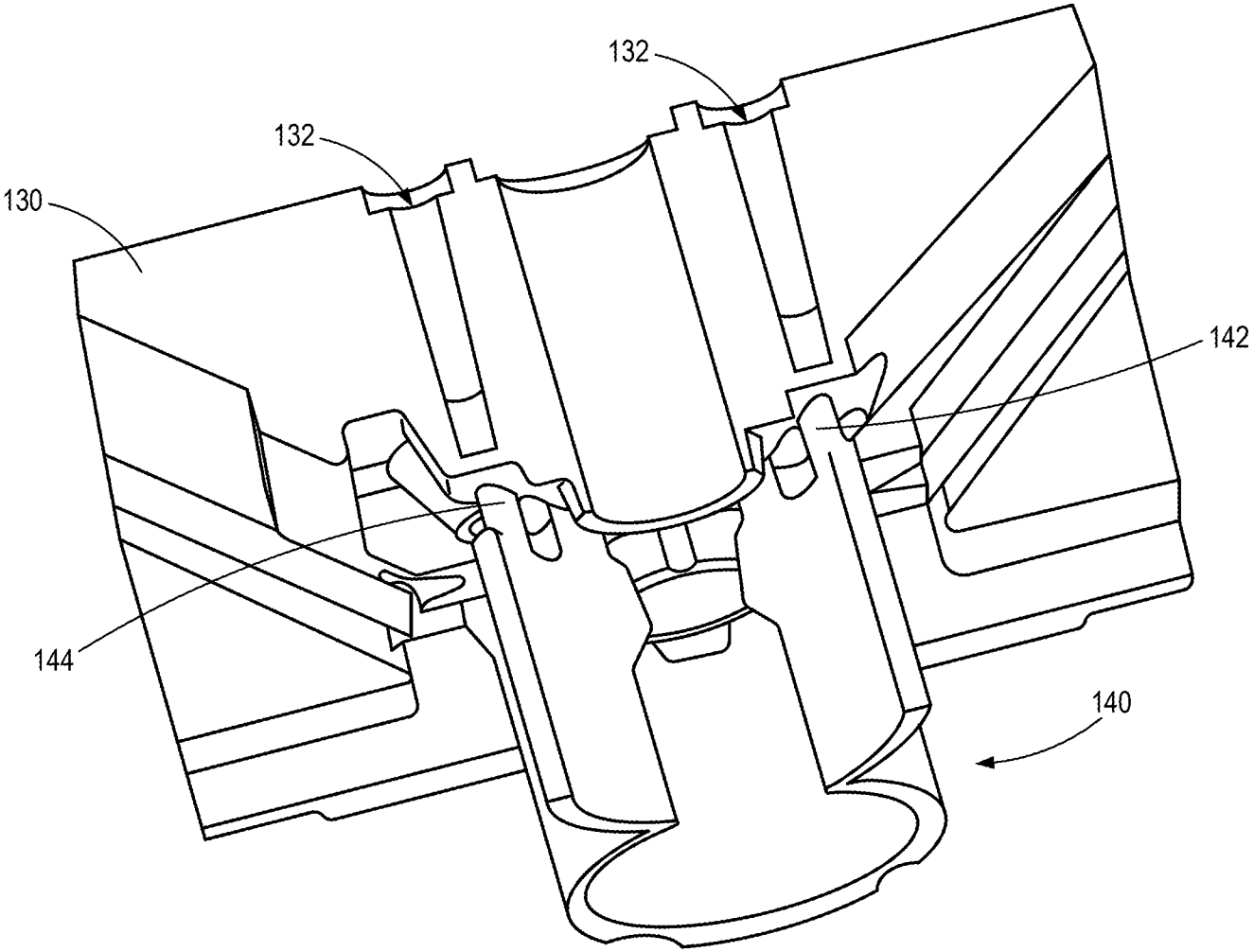
FIG. 6 illustrates a cross-sectional view of an embodiment of a slab core and an adjacent water jacket core.

As shown in the cross-sectional view of FIG. 6, conduit 132 terminates in between water jacket leg print 142 and water jacket leg print 144 of water jacket core 140. In other embodiments, one or more of the conduits may extend into the mold and may terminate adjacent to, or into, another portion of the mold that has been known to be particularly vulnerable to pressure build up and/or having marginal core print areas. Various embodiments disclosed herein may have particular applicability to any core having a high metal contact surface area to core print area ratio.

System 100 also comprises a vacuum plate 150 configured to be coupled with a vacuum. The vacuum applied to the vacuum plate 150, or to one or more other regions within and/or adjacent to the mold, may be between about −0.2 psi and about −1.0 psi. In some such embodiments and implementations, the vacuum may be between about −0.4 psi and about −0.6 psi. Further embodiments are contemplated in which the applied vacuum is greater. The strength of the vacuum may, in some embodiments, depend upon the materials being used and/or the permeability of the material defining the conduit(s) and/or the adjacent material.

Figure 7:
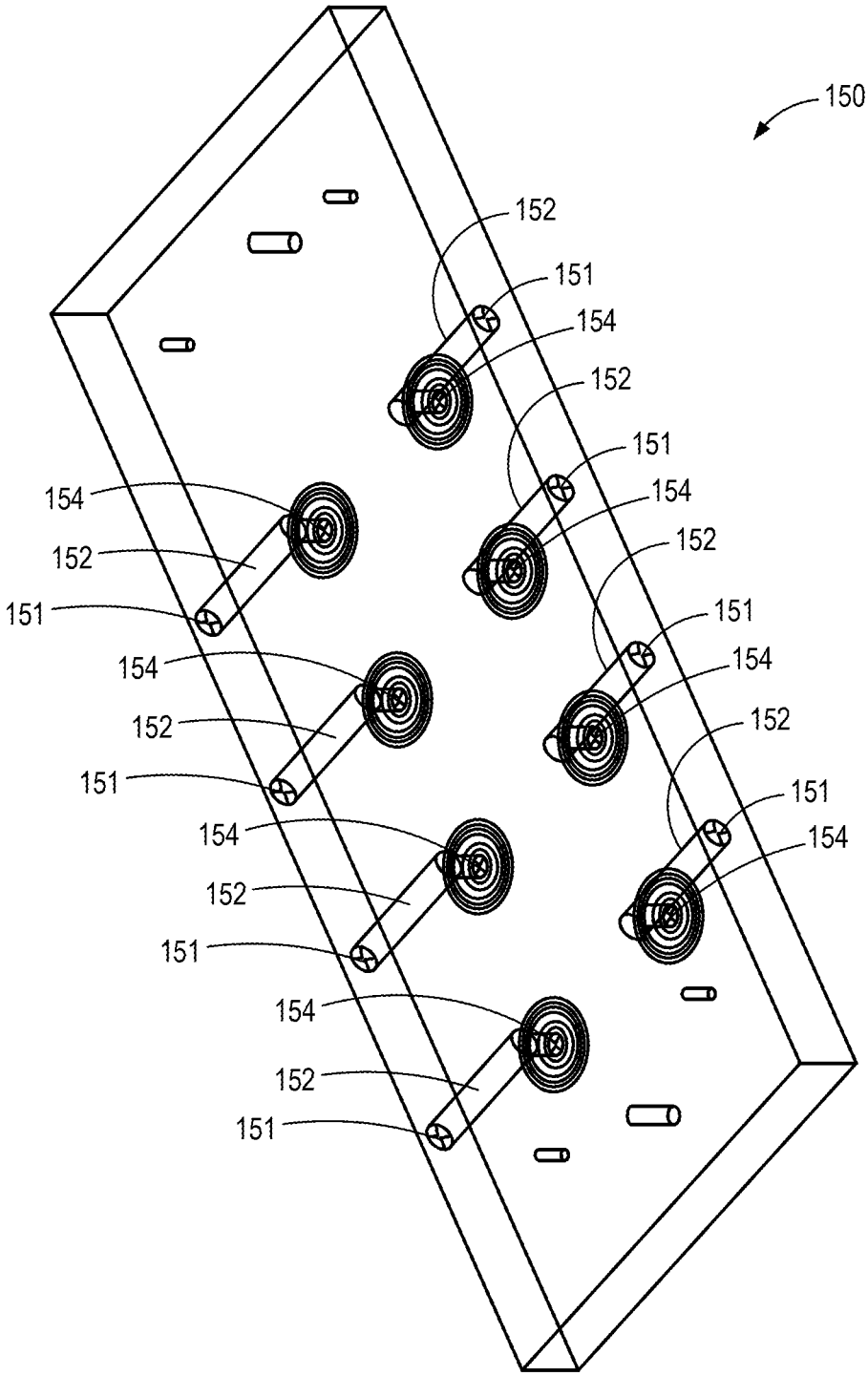
FIG. 7 illustrates a phantom perspective view of an embodiment of a vacuum plate comprising eight vacuum ports.

FIG. 7 illustrates a phantom perspective view of an embodiment of a vacuum plate 150 comprising eight vacuum ports 151. The vacuum ports 151 may be configured to facilitate coupling of a vacuum with one or more portions of the mold. For example, as shown in the cross-sectional view of FIG. 8, vacuum plate 150 may comprise a plurality of vacuum fittings 153 corresponding to, and coupled with, each of the vacuum ports 151. Vacuum fittings 153 may be coupled with vacuum plate 150 in any suitable manner, such as by way of a threaded coupling, friction fit, snap fit, bayonet, collet and clamp, etc. In other embodiments, vacuum fittings 153 may be integrally formed with vacuum plate 150.

Each of the vacuum ports 151 defines an opening to a conduit 152 formed within vacuum plate 150. At the end of each conduit 152 opposite from that of vacuum ports 151, a mold port 154 is formed that is configured to be fluidly connected with one or more portions of the mold comprising cover core 120, slab core 130, and water jacket core 140.

Each of the conduits 152 in the depicted embodiment is therefore fluidly connected with a corresponding conduit 122 that, in turn, is fluidly connected with a corresponding conduit 132. As such, when a vacuum is applied to vacuum fittings 153 and/or directly to vacuum ports 151, the pressure within conduits 122 and 132 is decreased. Since one or more portions of the mold are at least partially permeable, this reduction in pressure may be transferred to adjacent permeable portions of the mold to decrease the gas pressure within one or more particular regions within the mold in order to prevent or at least reduce gas formation with a molten material delivered into the mold.

In some embodiments, each of the vacuum fittings 153 may be coupled with a single vacuum manifold. Alternatively, multiple vacuum manifolds may be used. Or one or more of the vacuum fittings 153 and/or vacuum ports 151 may be coupled to a vacuum individually, as those of ordinary skill will appreciate.

Figure 8:
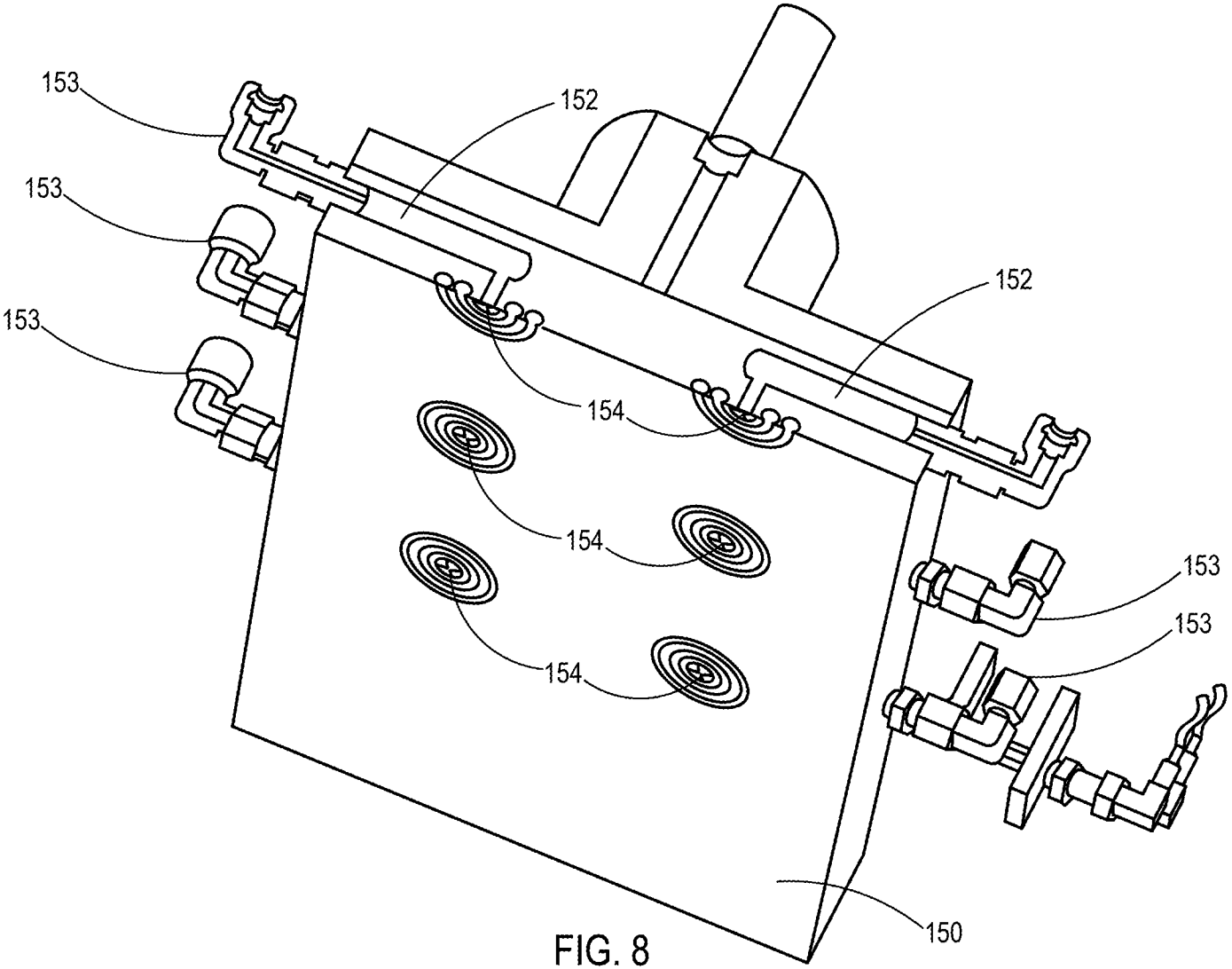
FIG. 8 illustrates a cross-sectional view of certain components of one embodiment of a system for manufacturing a metal casting including a vacuum for reducing gas pressure within one or more portions of the casting mold.

With regard to the embodiment depicted in the figures, a vacuum applied to vacuum fittings 153 and/or vacuum ports 151 reduces gas pressure within the water jacket core 140 adjacent to the full conduit defined by conduits 122, 132, and 152. As described above, this reduced pressure prevents or at least reduces bubble formation, and therefore bubble scrap, in precision sand castings produced from the mold/core materials FIG. 8 illustrates a cross-sectional view of certain components of system 100 for manufacturing a metal casting. FIG. 8 depicts conduits 152 formed within vacuum plate 150. Each of conduits 152 is fluidly connected with an adjacent conduit 122 in cover slab 120. As described above, each of the conduits 122 may be fluidly connected with a corresponding conduit 132. As such, vacuum plate 150 facilitates application of a vacuum to the mold comprising cover core 120, slab core 130, and water jacket core 140 that may be applied to one or more desired areas within the mold to reduce gas pressure, and therefore reduce bubble formation, in one or more regions of the mold known to be susceptible to such bubble formation. However, it is contemplated that some embodiments may omit vacuum plate 150 and may instead provide for application of a vacuum directly at one or more positions within, or adjacent to, the mold.

The foregoing specification has been described with reference to various embodiments. However, one of ordinary skill in the art will appreciate that various modifications and changes can be made without departing from the scope of the present disclosure. For example, various operational steps, as well as components for carrying out operational steps, may be implemented in alternate ways depending upon the particular application or in consideration of any number of cost functions associated with the operation of the system. Accordingly, any one or more of the steps may be deleted, modified, or combined with other steps. Further, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced, are not to be construed as a critical, a required, or an essential feature or element.

Those having skill in the art will appreciate that many changes may be made to the details of the above-described embodiments without departing from the underlying principles of the invention. The scope of the present invention should, therefore, be determined only by the following claims.

The invention claimed is:

1. A method for reducing gas pressure within an at least partially permeable mold for manufacturing a metal casting comprising an engine block, the method comprising the steps of:

providing a mold, wherein the mold comprises a mold core configured to create a cavity within a metal casting, wherein the mold core comprises a material that is permeable to gases introduced into the mold during a casting process, and wherein the mold core comprises a water jacket core and at least one core adjacent to the water jacket core;

delivering a molten metal into the mold to create a metal casting; and applying a vacuum to a plurality of conduits extending into a permeable portion of the mold during the step of delivering the molten metal into the mold to reduce gas pressure within the permeable portion of the mold, wherein at least one of the plurality of conduits extends to and terminates adjacent to the water jacket core without extending into the water jacket core, and wherein the at least one of the plurality of conduits extends to and terminates in a blind hole positioned in a core adjacent to the water jacket core and positioned adjacent to a leg print of the water jacket core without extending into the water jacket core, wherein the mold further comprises a vacuum plate comprising a plurality of vacuum ports, and wherein each of the vacuum ports is fluidly connected with at least one of the plurality of conduits.

2. The method of claim 1, wherein each of the plurality of conduits extends into the mold and terminates adjacent to the water jacket core.

3. The method of claim 2, wherein each of the plurality of conduits extends into the mold and at least one of the plurality of conduits terminates within about 10 mm of the water jacket core.

4. The method of claim 3, wherein the step of applying a vacuum to a permeable portion of the mold comprises coupling a vacuum manifold to the plurality of vacuum ports.

5. The method of claim 1, wherein the mold core comprises a sand material.

6. A method for manufacturing an engine block, the method comprising the steps of:

providing a mold, wherein the mold comprises a water jacket core configured to create a water jacket cavity within an engine block casting, wherein the water jacket core comprises a sand material that is permeable to gases introduced into the water jacket core during a casting process;

coupling a vacuum manifold to a plurality of vacuum ports, wherein at least one of the vacuum ports is fluidly connected with a conduit extending into the mold, and wherein the conduit terminates adjacent to the water jacket core without extending into the water jacket core, and wherein the conduit extends to and terminates adjacent to a leg print of the water jacket core in a blind hole formed in a core adjacent to the water jacket core without extending into the water jacket core;

delivering a molten metal into the mold to create an engine block casting; and applying a vacuum to the vacuum manifold during the step of delivering the molten metal into the mold to reduce gas pressure within the water jacket core.

7. The method of claim 6, wherein the plurality of vacuum ports are positioned within a vacuum plate, and wherein the vacuum plate is positioned adjacent to the mold during the step of applying a vacuum to the vacuum manifold.

8. A system for manufacturing a metal casting, comprising:

a mold configured to receive a molten metal to create a metal casting, wherein the mold comprises a mold core, and wherein the mold core is configured to create a cavity within the metal casting;

wherein the mold further comprises a cover core and a slab core positioned adjacent to the cover core, wherein the mold further comprises a water jacket core positioned adjacent to the slab core, wherein the water jacket core is configured to create a water jacket cavity within an engine block casting, wherein the cover core comprises at least one cover core conduit extending all the way through the cover core, wherein the slab core comprises at least one slab core conduit fluidly connected with the at least one cover core conduit, and wherein the at least one slab core conduit extends only partially through the slab core such that the at least one slab core conduit terminates adjacent to the water jacket core in a blind hole formed within the slab core without extending into the water jacket core, and wherein the at least one slab core conduit is at least substantially aligned with a longitudinal axis of the water jacket core;

a filling device configured for delivering a molten metal into the mold for creating the metal casting, wherein the mold core comprises a material that is permeable to gases introduced into the mold during a process of delivering the molten metal into the mold with the filling device; and a vacuum configured to be coupled with the mold to reduce gas pressure within a permeable portion of the mold.

9. The system of claim 8, further comprising a vacuum plate configured to be coupled with the vacuum.

10. The system of claim 9, wherein the vacuum plate comprises at least one vacuum port configured to facilitate coupling of the vacuum with the mold.

11. The system of claim 10, wherein the vacuum port is fluidly connected with the at least one cover core conduit extending into the mold.

12. The system of claim 8, wherein the at least one slab core conduit extends into the mold and terminates within about 10 mm of the water jacket core.

* * * * *